United States Patent [19]

Eriksson

[11] 4,393,983

[45] Jul. 19, 1983

[54] INTERMESHING SCREW-TYPE REFINER

[76] Inventor: Erik F. Eriksson, Ymsenvägen 9[1], S-121 42 Johanneshov, Sweden

[21] Appl. No.: 286,644

[22] Filed: Jul. 24, 1981

Related U.S. Application Data

[63] Continuation of Ser. No. 177,749, Dec. 28, 1979, abandoned.

[30] Foreign Application Priority Data

Apr. 28, 1978 [GB] United Kingdom ..... 17035/78

[51] Int. Cl.[3] ..... B30B 3/04; B30B 15/32

[52] U.S. Cl. ..... 222/233; 222/235; 222/238; 222/412; 222/564; 100/146; 100/148

[58] Field of Search ..... 100/146–148; 241/260.1, 261; 162/24, 26; 222/238, 412, 413, 564, 235, 234, 233; 366/77, 84, 85, 86, 301, 321

[56] References Cited

U.S. PATENT DOCUMENTS

| | | | |
|---|---|---|---|
| 567,509 | 9/1896 | Reitz | 366/321 X |
| 2,119,162 | 5/1938 | Hartner | 100/146 |
| 2,452,555 | 11/1948 | De La Rosa, Sr. | 100/148 X |
| 2,458,068 | 1/1949 | Fuller | 100/146 X |
| 2,778,482 | 1/1957 | Lasch et al. . | |
| 3,023,455 | 3/1962 | Geier et al. | 366/321 X |
| 3,111,082 | 11/1963 | Larsson et al. | 100/147 |
| 3,856,278 | 12/1974 | Werner et al. . | |
| 4,121,967 | 10/1978 | Reinhall | 100/148 X |

FOREIGN PATENT DOCUMENTS

| | | | |
|---|---|---|---|
| 613378 | 5/1935 | Fed. Rep. of Germany | 100/148 |
| 1904776 | 8/1970 | Fed. Rep. of Germany . | |
| 1046159 | 12/1953 | France . | |
| 1608587 | 1/1977 | Sweden . | |

*Primary Examiner*—David A. Scherbel
*Attorney, Agent, or Firm*—Witherspoon & Hargest

[57] ABSTRACT

In a refiner for treating cellulose pulp or similar material of the type comprising two intermeshing rotary screws operating in a housing having a material inlet and a material outlet, the surface of each screw comprises a feeding thread section merging into a feed-resisting surface section, the outlet being provided in a side-wall of the housing near the zone where the feeding thread sections on both screws end and the feed-reversing surface sections begin. The outlet opens into an outwardly flaring collar having a plane mouth opening oblique in relation to the direction of material discharge through the material outlet. The mouth opening cooperates with a closure element to restrict the outlet area to control working pressure conditions within the housing.

19 Claims, 6 Drawing Figures

INTERMESHING SCREW-TYPE REFINER

This application is a continuation of application Ser. No. 06/177,749, filed Dec. 28, 1979, now abandoned.

FIELD OF THE INVENTION

The invention relates to an apparatus of the type basically disclosed in British Pat. No. 1,229,894 and Swedish Pat. No. 314,288, such apparatus being designed for treating cellulose pulp or similar material and comprising two intermeshing rotary screws working in a housing enclosing the intermeshing screws and provided with a material inlet and a material outlet. The screws are coupled for synchronized intermeshing rotation during which material such as paper pulp fed into the inlet is conveyed by the interaction of the screws towards the outlet and treated during passage through the space defined by the threads of the screws and the surrounding housing towards the outlet.

BACKGROUND

For optimum treatment of the material in the apparatus it is necessary to discharge the treated material from the apparatus against a controlled counteracting pressure. This problem is solved according to Swedish Pat. No. 314,288 by providing a variable outlet opening between a stationary end-portion of the apparatus and a housing portion shiftable in the longitudinally direction of the screws and biased against the stationary end-portion with an adjustable pressure.

In the construction of a double screw refiner according to British Pat. No. 1,229,894 the housing is stationary and discharge is performed through apertures around the outlet end-portions of the shafts carrying the screw threads. Practical experience has shown that controlled discharge through a variable outlet opening is a factor of great importance for the refining result obtained. The solution of this problem proposed in Swedish Pat. No. 314 288 however, does not appear to be ideal for the following reasons.

SUMMARY OF THE INVENTION

1. Basically, the arrangement according to Swedish Pat. No. 314 288 is complicated and expensive. In order to control the discharge from the machine the housing must be mobile. Thus, resilient connections are required between the housing and the stationary supply and discharge tubes, such connections at the same time being impermeable and insensitive to both pressure and temperature. Such connections require much space and the rubber material used in such connecting bellows will be subject to fatigue due to the uninterrupted movements. Further, the axial movement in the seals between the housing and the shaft causes abnormal wear and difficulties in maintaining the required sealing effect. The axial shifting movement also precludes packings of the labyrinth or similar type which otherwise are specifically suited in a machine of the present type when the relative speeds are high.

2. As in this prior construction fiber material in comparatively solid form (due to high concentration) is caused to rotate at high pressure and high speed against the end-wall of the housing, considerable energy losses are encountered. Also, the frictional heat generated at the end-wall and reaching values up to within the range of 80° to 95° C. tends to burn the pulp when material is treated at high dry-matter content.

3. By feeding the material against the end-wall the shafts are exposed to axial thrusts of a magnitude requiring the use of special expensive bearings.

4. The high degree of friction in the discharge range causes heavy wear of this part of the machine. Due to the heavy wear in the discharge the outlet control may not be fully efficient when material causing heavy wear, such as waste paper, is treated.

All the above described difficulties are avoided by means of a combination of novel constructive features applied to a double screw refiner of the type as defined above, the essential inventive steps residing in providing a feed-reversing surface section on both screws starting near the end of the ordinary feeding screw thread section, placing the material outlet in the side-wall of the elongate housing—normally the downwardly facing part of the side-wall—near the transition from the feeding screw thread section to the feed-reversing surface section, providing an outwardly flaring collar bounding said material outlet and having an outlet opening extending in a plane oblique to the direction of material discharge, and means selectively restricting the outlet area of said collar outlet opening said means being variably biased towards an outlet closing position to selectively oppose the exit pressure of the material through said collar outlet, thereby to achieve material discharge conditions optimizing material pressure and thereby treating conditions within the housing.

Another essential aspect of the invention comprises selecting the pitch and shape of the thread on both screws to establish a high material pressure zone within said housing in the range of said material outlet.

By successfully solving the problem of controlled lateral material discharge, this novel construction fully eliminates the drawbacks experienced with prior-art refiners of the intermeshing-screw type.

1. There is no need for a mobile housing. Accordingly both the inlet and the outlet can be stationarily attached to supply and discharge conduits, respectively. The shafts of the screws in the normal way extend through stationary end-walls of the housing and, accordingly, normal bearings and packings of the most convenient types may be used.

2. Due to the fact that feeding and feed-reversing portions are provided on the same screw shaft pressure contact between the housing outlet end-wall and the compacted treated material is avoided. Thereby energy is saved and undue frictional heating of the material is avoided.

3. As the material is no longer fed forward against the outlet end-wall of the housing, noxious axial thrusts on the shafts are avoided.

4. The present construction reduces wear of both the screws and the discharge opening. Control of the working intensity is improved due to the fact that the machine elements controlling the discharge are no longer deformed by wear. This is of particular importance in connection with the treatment of waste paper. The improvement as far as reduction of wear is concerned is mainly due to the fact that the material is not discharged between surfaces having large relative velocities.

Additional advantages obtained by the present invention are the considerable saving in building cost as compared to the construction according to Swedish Pat. No. 314,288, the possibility to subdivide the housing mantel vertically permitting disassembly of the screws without disconnection of the supply and discharge conduits, and the ability of the screw shafts to be adjusted angularly in relation to each other, such adjustment being compatible with the lateral disposition of the outlet but incompatible with discharge of treated material in an axial direction.

DETAILED DESCRIPTION OF PREFERRED EMBODIMENTS

Figure 1:
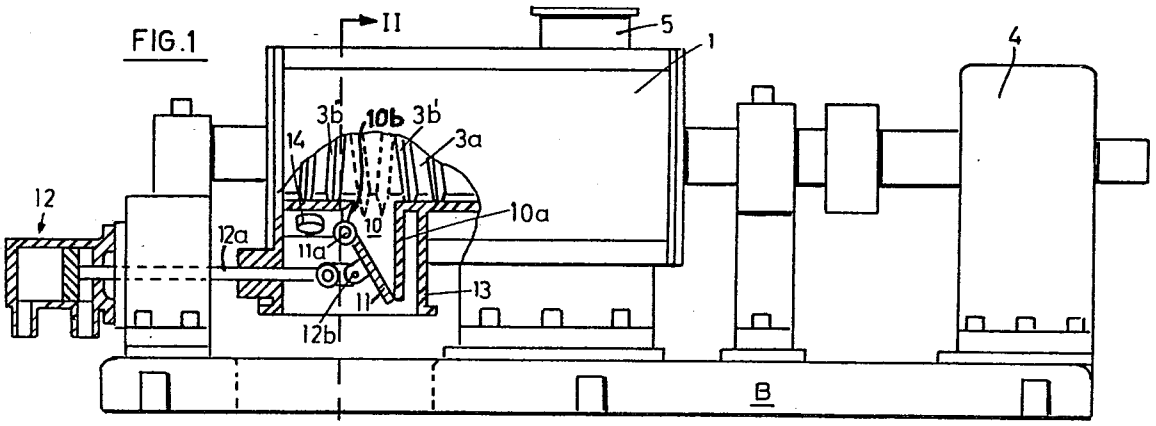
FIG. 1 is an elevational view of the refiner of the invention with parts broken away or shown in section.
Figure 2:
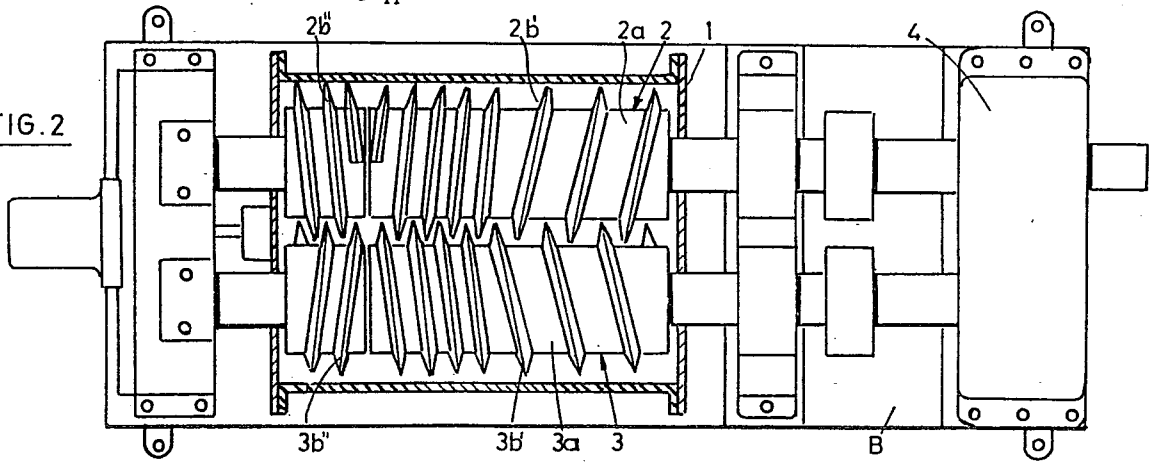
FIG. 2 is a plan view with the upper part of the housing shown in section.

In all the embodiments of the invention shown a refiner housing 1 encloses two intermeshing screws 2 and 3 of mutually opposite pitch. Each screw 2 and 3 has a cylindrical core 2*a* and 3*a*, respectively, each such core carrying a treating screw thread 2*b* and 3*b*, respectively. On each screw the treating screw thread is subdivided into two sections of mutually opposite pitch in such a way that during operation of the apparatus the right-hand section 2*b*′ and 3*b*′, respectively, of each screw 2 and 3 as seen in FIGS. 1 and 2 will perform a feeding action from the right to the left, whereas the left-hand section 2*b*″ and 3*b*″, respectively, will perform an action reversing the feeding action performed by sections 2*b*′ and 3*b*′, respectively.

The screw shafts are driven in unison and in mutually opposite directions by a motor and gear unit 4. Material to be treated, e.g. cellulose pulp at a concentration in excess of 12.5%, preferably 25% or more, is supplied to the housing through an inlet 5 arranged in the housing substantially above the feed-starting end of feeding screw thread portion 2*b*′ and 3*b*′, respectively. All the parts of the refiner, mentioned so far, are in a conventional way supported by a bed structure B.

The bearing and drive means of the intermeshing screws are conventional and do not require a more detailed description.

In cotrast to prior-art technique such as represented by Swedish patent specification No. 314,288 the outlet through which material treated during passage through the interspaces between the intermeshing screws and the housing is discharged, is not provided in the end-wall of the refiner housing remote from inlet 5 but in the bottom wall of the housing. A discharge aperture 10 extends through the bottom wall of the housing 1 centrally below the horizontally disposed pair of screws and at a position lengthwise of said screws 2 and 3 adjacent the terminal end of the feeding screw thread portions 2*b*′ and 3*b*′ of respectively screws 2 and 3.

Figure 3:
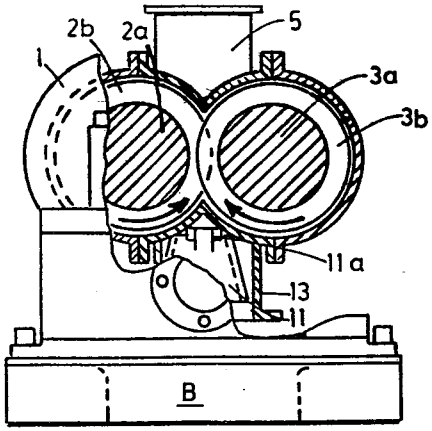
FIG. 3 is an end-view of the refiner in part in section along the line II—II in FIG. 1.

It will be understood that with the thread pitch illustrated in FIG. 2 material transport from the inlet 5 through the machine towards aperture 10 will require a direction of rotation of the screws as indicated by arrows in FIG. 3 which means that a zone of material compression will be created in the bottom of the machine where intermeshing screw thread sections are rotating towards each other in contrast to conditions on the upper side of the screws where intermeshing screw thread sections move apart and thus release the pressure acting on the material enclosed between the screw flanges. Due to the feed reversing action of screw sections 2*b*″ and 3*b*″ such material compression will be concentrated near discharge aperture 10 causing the treated material to pass through said aperture under desirable radial exit pressure and in a direction substantially at right angles in relation to a plane through the axes of said screws.

As shown in FIG. 1, a collar 10*a* bounding said aperture 10 extends outwardly from housing 1.

As shown in FIG. 3 and further indicated by wall portion 10*b* in FIG. 1, this collar 10*a* has a generally outwardly flaring configuration.

Moreover, the collar has a mouth opening extending in a plane oblique to the general direction of material discharge, said mouth opening cooperating with a plane closure element in the form of a flap 11 pivotally attached as at 11*a* to the edge of collar wall 10*b* adjacent aperture 10. This construction avoids any abrupt change of the direction of movement of the material through the collar 10*a* and past flap 11 when the position of the flap 11 is adjusted enabling discharge to be controlled smoothly.

Flap 11 is designed to oppose the discharge of treated cellulosic material from the interior of the housing through aperture 10 and collar 10*a* to the extent necessary to produce within the apparatus such pressure conditions as required for optimum treating results. For this purpose flap 11 is adjustably biased towards an outlet closing position with the aid of a fluid-actuated means such as the cylinder and piston means 12 shown having a piston rod 12*a* pivotally connected as at 12*b* to the outward face of flap 11. By suitable supply of fluid to cylinder and piston device 12 the resistance offered by flap 11 against discharge of material can be adjusted. Obviously, automatic adjustment in dependence on operational parameters is feasible, such parameters for example being the load of the motor driving the screws or the measured pressure prevailing in the material enclosed between the intermeshing screws and the housing.

In order to permit attachment of the outlet to discharge counduit means a second collar 13 may extend outwardly from housing 1 in a position enclosing the first collar 10*a* as well as flap 11 and part of piston rod 12*a* extending from pivot 12*b*.

In the operation of an apparatus of the type here in question pressure conditions within the material treated may be such that certain de-watering of the material occurs, the water thus released collecting in the bottom portion of housing 1. Due to the fact that the feed-reversing screw thread portions 2*b*″ and 3*b*″ prevent an accumulation of pressurized treated material in the neighbourhood of the outlet end-wall of housing 1, such accumulated water may collect in the bottom of the housing there and may be removed by means of a draining hole 14 provided, for example, within the second collar 13.

It may be mentioned that the lateral discharge of the treated material from housing 1 may be improved by selecting the pitch of the feed-reversing screw thread portions 2*b*″ and 3*b*″ so as to provide a desirable radial exit pressure of the material against flap 11 or any other means used instead of such flap. The shape of the feed-reversing screw thread portions 2*b*″ and 3*b*″ may also be specifically adjusted to yield a substantially radially directed material pressure in the outlet. Such modifications of the pitch and shape of the treating thread portion of intermeshing rotary screws are within the professional knowledge of the expert.

Figure 4:
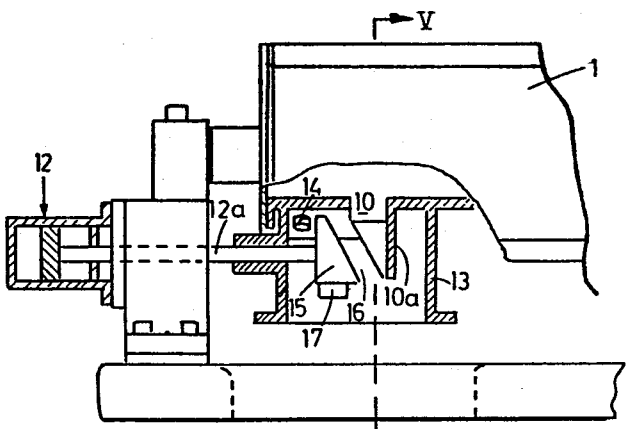
FIG. 4 is an elevational, partly sectioned view of the discharge end of a refiner similar to that shown in FIG. 1 but provided with an alternative discharge-resisting mechanism.
Figure 5:
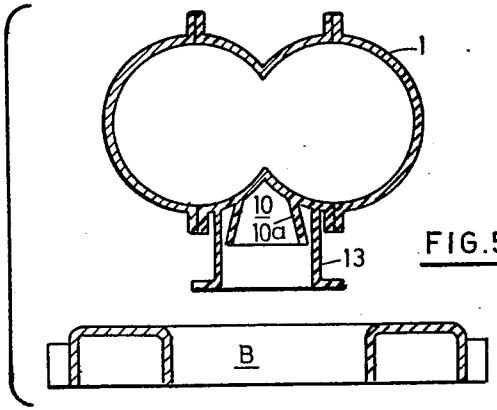
FIG. 5 is a section along line V—V in FIG. 4.

The alternative embodiment of the apparatus as illustrated in FIGS. 4 and 5 is distinguished from the embodiment shown in FIGS. 1 to 3 merely by the fact that the plane outlet restricting closure element is not a flap but a kind of wedge body 15 presenting a plane inclined surface 16 to the material under discharge through aperture 10 and collar 10*a*, which also in this embodiment has a generally outwardly flaring configuration as shown in FIG. 5 and an oblique mouth opening. By means 12, 12*a* similar to those described in connection with the embodiment according to FIGS. 1 to 3 body 15 to shiftable between a position, in which its plane surface 16 closes the plane opening defined by collar 10, and selective positions, in which said plane surface 16 selectively uncovers the plane opening bounded by the free end of collar 10*a*. In its shifting movement body 15 is supported by a bearing surface 17 carried by bed structure 13.

As far as operation is concerned, the description given in connection with the embodiment according to FIGS. 1 to 3 also applies to the embodiment according to FIGS. 4 and 5.

It will be understood that other types of outlet closures may be provided within funnel-like structures such as collars 13 permitting attachment of the outlet to discharge tubes or the like.

Figure 6:
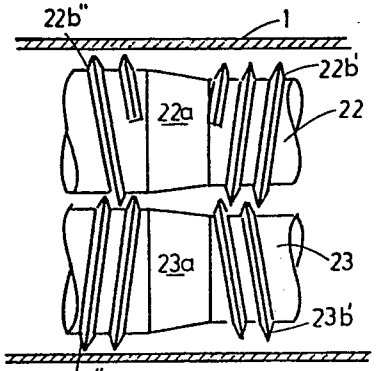
FIG. 6 is a partial view of an intermediate section of the intermeshing screws according to another embodiment of the invention.

FIG. 6 illustrates an alternative embodiment of the intermeshing rotary screws which under certain operating conditions and with certain treated materials may yield additionally improved discharge of the material through outlet hole 10. In the same way as in the previously described embodiments the feed-reversing thread portion 22*b*″ and 23*b*″ have the same outside diameter as the corresponding feeding screw thread portions 22*b*″ and 23*b*″, respectively. However, in contrast to the previously described embodiments the feed-reversing screw thread portions 22*b*″ and 23*b*″ have lesser hight and correspondingly increased core thickness compared to the feeding screw thread portions 22*b*′ and 23*b*′, the screw core being provided with a transition zone 22*a* and 23*a*, respectively, having truncated conical shape, the position of said conical portions 22*a* and 23*a* substantially coinciding with the position of outlet aperture 10 longitudinally of said screws 22 and 23. Obviously the feed-reversing section of the screws may be exclusively constituted by truncated conical surface sections extending from the terminal end of the feeding screw thread section on each screw to the end-wall of the housing beyond the outlet. This as well as other modifications and equivalents of the arrangements described above are intended to fall within the scope of the present invention.

I claim:

1. Apparatus of the type used for treating cellulose pulp, comprising two intermeshing rotary screws driven synchronously within a housing having lateral and end walls and having a material inlet and a material outlet in the range of respectively an inlet and an outlet end of the housing, each screw on a cylindrical core carrying a surface section constituting a treating screw thread, said screw thread comprising a feeding screw thread section starting near said inlet and having a terminal end spaced from said housing outlet end, said cylindrical core further carrying a feed-reversing surface section starting near the terminal end of said feeding screw thread section and having a terminal end near said housing outlet end, said material outlet being provided in the lateral wall of said housing adjacent the terminal end of the feeding screw thread sections of both screws for discharge of treated material substantially at right angles in relation to a plane through the axes of said screws, an outwardly flaring collar outwardly extending from said lateral housing wall around said material outlet, said collar having an outlet opening extending in a plane oblique to the direction of material discharge, means being provided outwardly of said collar selectively to restrict the outlet area of said collar outlet opening, said restricting means comprising a closure element moveable between a position in which said oblique collar outlet opening is substantially closed and opening positions in which said oblique collar outlet opening is selectively uncovered, adjustable means being provided controlling the movement of said closure element to selectively establish the resistance offered by said restricting means against discharge of material through said outlet.

2. The apparatus as claimed in claim 1 wherein said closure element comprises a plane closure element, said element being adjustabley biased towards an outlet closing position.

3. The apparatus as claimed in claim 2, in which means are provided controlling the closing bias acting on the plane closure element in dependence on the load of a motor synchronously driving said screws.

4. The apparatus as claimed in claim 2, in which means are provided controlling the closing bias acting on the restricting means in dependence on the pressure prevailing in the material enclosed between the intermeshing screws.

5. The apparatus as claimed in claim 1, in which said plane closure element is an outlet closing flap adjustably biased towards said outlet closing position.

6. The apparatus as claimed in claim 1, in which said feed-reversing surface section is a screw-thread section.

7. The apparatus as claimed in claim 6, in which the pitch of said feed-reversing screw thread section is selected to provide a desirable radial exit pressure of the material against said restricting means.

8. The apparatus as claimed in claim 6, in which said feed-reversing screw thread section is shaped to yield a substantially radially directed material pressure.

9. The apparatus as claimed in claim 6, in which said feed-reversing screw thread section has the same diameter as said feeding screw thread section but lesser hight and correspondingly increased core thickness, a transition zone of said core between said screw thread sections having truncated conical shape.

10. The apparatus as claimed in claim 1, in which said feed-reversing surface section has truncated conical shape.

11. The apparatus as claimed in claim 1, in which at least one draining hole is provided in said housing at a lowermost position near said outlet.

12. The apparatus as claimed in claim 1, in which said screws are horizontally disposed side by side, said outlet being provided centrally below said pair of screws in the form of an aperture in the lateral wall of the housing, a first outwardly flaring collar bounding said aperture extending outwardly from said housing and having a oblique mouth opening adapted to cooperate with said restricting means.

13. The apparatus as claimed in claim 12, in which a second collar extends outwardly from said housing in a position enclosing said first collar and said restricting means.

14. The apparatus as claimed in claim 13, in which at least one draining hole extends through the wall of said housing within said second collar.

15. The apparatus as claimed in claim 1, in which said plane closure element is a body having a plane surface of a shape and size to cover said outlet plane opening, said body being shiftable between a position in which said plane surface closes said plane opening and selective positions in which said plane surface selectively uncovers said plane opening, said body being adjustably biased towards said closing position.

16. The apparatus as claimed in claim 15, in which said plane surface extends in parallel to said outlet opening in any shifting position of said body.

17. The apparatus as claimed in claim 1, in which means controlling the movement of said plane closure element are fluid-actuated means.

18. The apparatus as claimed in claim 17, in which opposed corresponding portions on the screws are moving towards each other in the range of rotation extending between the lateral housing wall portion in which said material outlet is provided and a plane through the axes of said screws.

19. Apparatus of the type used for treating cellulose pulp, comprising two intermeshing rotary screws driven synchronously within a housing having lateral and end walls and having a material inlet and a material outlet in the range of respectively an inlet and an outlet end of the housing, each screw on a cylindrical core carrying a surface section constituting a treating screw thread, said screw thread comprising a feeding screw thread section starting near said inlet and having a terminal end spaced from said housing outlet end, said cylindrical core further carrying a feed-reversing surface section starting near the terminal end of said feeding screw thread section and having a terminal end near said housing outlet end, said material outlet being provided in the lateral wall of said housing adjacent the terminal end of the feeding screw thread sections of both screws for discharge of treated material substantially at right angles in relation to a plane through the axes of said screws, said screws being caused to rotate during operation of said apparatus such that opposed corresponding portions on said screws are caused to move towards each other in the range of rotation extending between the lateral housing wall portion in which said material outlet is provided and a plane through the axes of said screws, the pitch of the thread on both screws being selected to establish a high material pressure zone within said housing in the range of said material outlet, said material outlet cooperating with means selectively restricting the outlet area of said material outlet.

* * * * *